US008322713B2

(12) United States Patent
Oota et al.

(10) Patent No.: US 8,322,713 B2
(45) Date of Patent: Dec. 4, 2012

(54) CROSS CONVEYING DEVICE

(75) Inventors: Ryuichi Oota, Kinokawa (JP); Hideki Oiwa, Kinokawa (JP); Masasuke Funase, Kinokawa (JP); Takaaki Maeda, Kinokawa (JP); Akihiko Toki, Kinokawa (JP)

(73) Assignee: Duplo Seiko Corporation, Wakayama (JP)

( * ) Notice: Subject to any disclaimer, the term of this patent is extended or adjusted under 35 U.S.C. 154(b) by 0 days.

(21) Appl. No.: 13/264,527

(22) PCT Filed: Apr. 5, 2010

(86) PCT No.: PCT/JP2010/056155

§ 371 (c)(1),
(2), (4) Date: Oct. 14, 2011

(87) PCT Pub. No.: WO2010/119786

PCT Pub. Date: Oct. 21, 2010

(65) Prior Publication Data

US 2012/0049443 A1 Mar. 1, 2012

(30) Foreign Application Priority Data

Apr. 17, 2009 (JP) ..... 2009-101027
Apr. 17, 2009 (JP) ..... 2009-101029

(51) Int. Cl.
*B65H 5/00* (2006.01)

(52) U.S. Cl. ..... 271/225; 271/226; 271/254; 271/177; 271/184

(58) Field of Classification Search ..... 271/225, 271/226, 177, 178, 184, 253, 254
See application file for complete search history.

(56) References Cited

FOREIGN PATENT DOCUMENTS

| | | | |
|---|---|---|---|
| JP | 59-57430 | U | 4/1984 |
| JP | 60-34835 | A | 2/1985 |
| JP | 3-138245 | A | 6/1991 |
| JP | 2007-106558 | A | 4/2007 |
| JP | 2010-30766 | A | 2/2010 |

OTHER PUBLICATIONS

International Search Report (PCT/ISA/210) issued on Jun. 8, 2010, by Japanese Patent Office as the International Searching Authority for International Application No. PCT/JP2010/056155.
Written Opinion (PCT/ISA/237) issued on Jun. 8, 2010, by Japanese Patent Office as the International Searching Authority for International Application No. PCT/JP2010/056155.

*Primary Examiner* — Michael McCullough
(74) *Attorney, Agent, or Firm* — Buchanan Ingersoll & Rooney PC

(57) ABSTRACT

When the sheet (100) is mounted onto the conveyance surface (20), the alignment guide (3) is located at the retraction position by the alignment guide moving mechanism, and after the sheet (100) is mounted onto the conveyance surface (20), the alignment guide (3) is located at the guide position by the alignment guide moving mechanism.

2 Claims, 5 Drawing Sheets

CROSS CONVEYING DEVICE

TECHNICAL FIELD

The present invention relates a cross conveying device for mounting a planar-view-rectangle sheet, which has been conveyed from a preceding devise toward a first direction, onto a conveyance surface and conveying the sheet toward a second direction perpendicular to the first direction while moving it along an alignment guide.

BACKGROUND OF THE INVENTION

The above cross conveying device for mounting a planar-view-rectangle sheet, which has been conveyed from a preceding devise toward a first direction, onto a conveyance surface and conveying the sheet toward a second direction perpendicular to the first direction while moving it along an alignment guide, has been disclosed in Patent Document 1. And the alignment guide in Patent Document 1 has a lot of rotatable spherical bodies which are provided so as to mount onto a sheet abutting on a guide surface of the alignment guide. Other similar techniques are disclosed in Patent Documents 2-4.

Patent Document 1: Japanese Unexamined Patent Application Publication No. 60-34835

Patent Document 2: Japanese Unexamined Utility Model Publication No. 59-57430

Patent Document 3: Japanese Unexamined Patent Application Publication No. 2007-106558

Patent Document 4: Japanese Unexamined Patent Application Publication No. 3-138245

DISCLOSURE OF THE INVENTION

Problems to be Solved by the Invention

FIG. 9 is a cross-sectional view showing a state when a sheet 100 having a folded configuration is mounted onto a conveyance surface 20 of a cross conveying device from a preceding device. The conveyance surface 20 is comprised of a lot of conveying rollers 2. In the device shown in FIG. 9, the sheet 100 having finished mounting onto the conveyance surface 20 is intended to become into a state that a front edge (fold line) 101 passes through under spherical bodies 331, 321 of an alignment guide 3 and abuts on a guide surface 31. Therefore, a distance L of the guide surface 31 from a reference position P is set to a length of the first direction of the sheet 100 having a folded configuration. Incidentally, the reference position P is a position of a rear edge 102 of the first direction of the sheet 100 when the sheet 100 has finished mounting onto the conveyance surface 20.

However, in a case shown in FIG. 9, if the sheet 100 is easy to break, the sheet 100 can not push up the spherical bodies 331, 321 and also jams short of the spherical bodies 331, 321 when mounting onto the conveyance surface 20. Therefore, it results that the sheet 100 is not completely mounted onto the conveyance surface 20 and is not conveyed.

An object of the present invention is to provide a cross conveying device which can mount the sheet onto the conveyance surface reliably and convey the sheet while guiding it by the alignment guide, even if the sheet is easy to break.

Means for Solving the Problems

The present invention is a cross conveying device for mounting a planar-view-rectangle sheet, which has been conveyed from a preceding devise toward a first direction, onto a conveyance surface and conveying the sheet toward a second direction perpendicular to the first direction while moving it along the alignment guide, wherein the alignment guide comprises a guide surface which abuts on a front edge of the first direction of the sheet and guides the sheet, and a rotatable spherical body which mounts onto the sheet abutting on the guide surface and applies a load to the sheet, an alignment guide moving mechanism is provided, the alignment guide moving mechanism comprises a reciprocating mechanism which can reciprocate the alignment guide along the first direction, and a movement control part which controls the reciprocating mechanism, the reciprocating mechanism is formed so as to be able to move the alignment guide between a guide position where the guide surface abuts on the front edge of the first direction of the sheet having finished mounting onto the conveyance surface and a retraction position where the spherical body does not make contact with the front edge of the first direction of the sheet having finished mounting onto the conveyance surface, the movement control part controls the reciprocating mechanism so as to move the alignment guide from the guide position to the retraction position when the movement control part detects a time when the sheet begins to mount onto the conveyance surface, and the movement control part controls the reciprocating mechanism so as to move the alignment guide from the retraction position to the guide position when the movement control part detects a time when the sheet has finished mounting onto the conveyance surface.

Effects of the Invention

In the present invention, when the sheet having been conveyed from the preceding device is mounted onto the conveyance surface, the alignment guide is located at the retraction position, therefore, it does not result that the sheet jams short of the spherical bodies of the alignment guide. Also, after the sheet is mounted onto the conveyance surface, the alignment guide is located at the guide position, therefore, the front edge of the sheet abuts on the guide surface reliably. Therefore, the cross conveying device of the present application can mount the sheet onto the conveyance surface reliably and convey the sheet while guiding it by the alignment guide, even if the sheet is easy to break.

DESCRIPTION OF REFERENCE NUMERALS

10: cross conveying device, 100: sheet, 101: front edge (folded line), 20: conveyance surface, 3: alignment guide, 31:

guide surface, 321, 331: spherical body, 4: alignment guide moving mechanism, 41: reciprocating mechanism

BEST MODE FOR CARRYING OUT THE INVENTION

Figure 1:
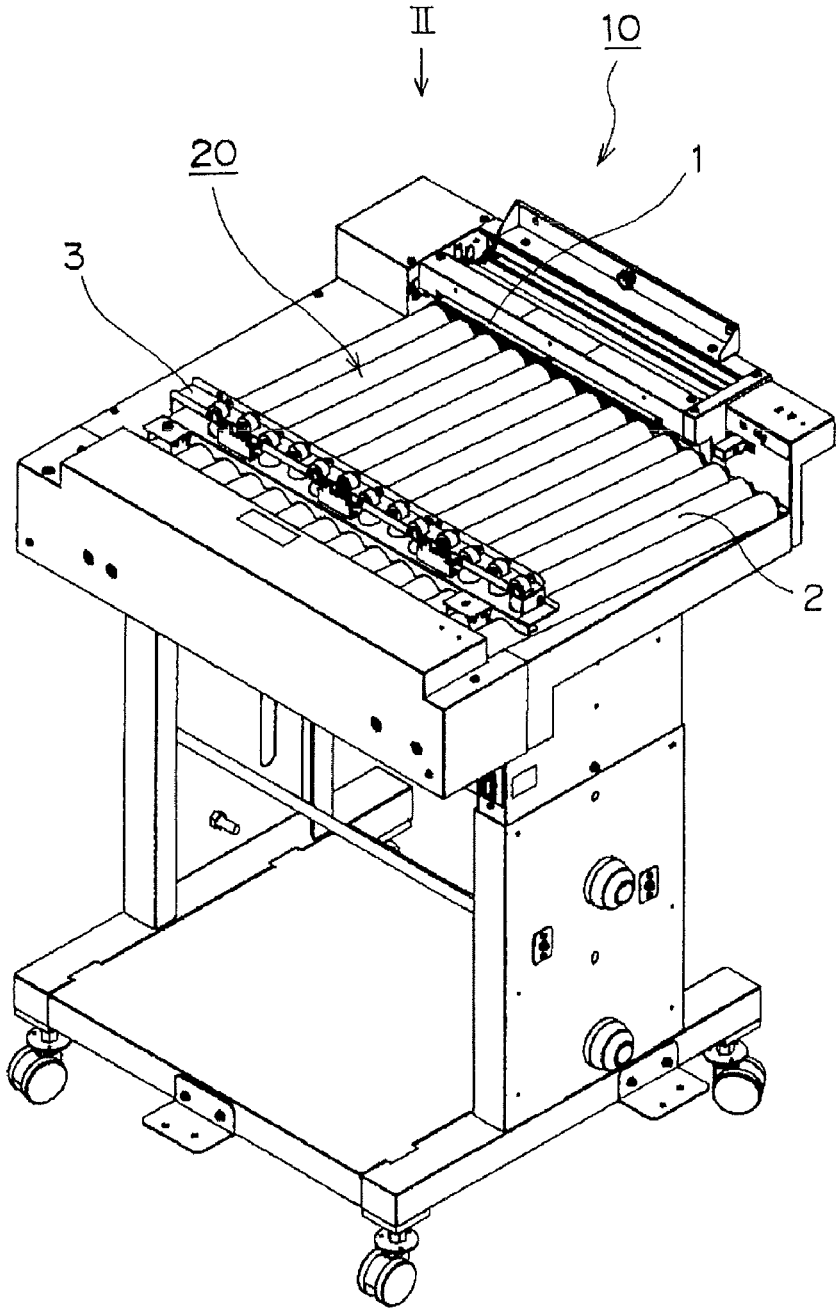
FIG. 1 is a perspective partial view of a cross conveying device of the present invention.
Figure 2:
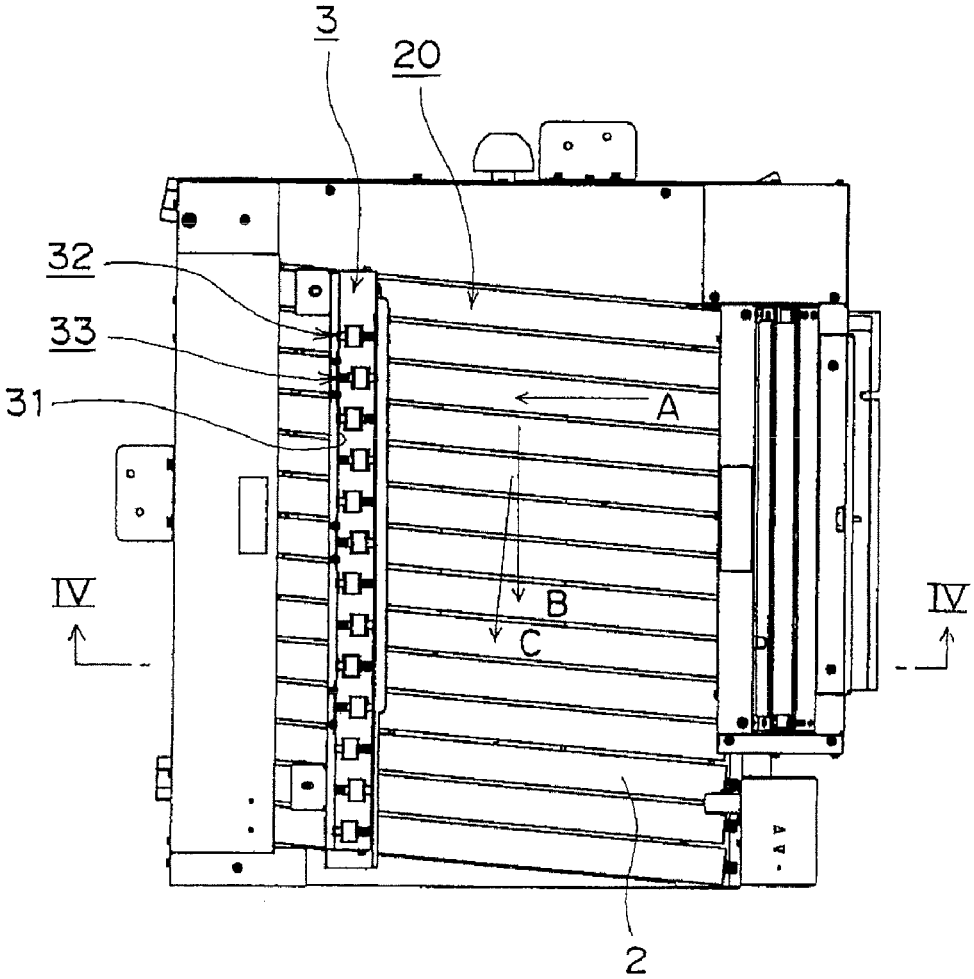
FIG. 2 is a view in the direction of the arrow II in FIG. 1.

FIG. 1 is a perspective partial view of a cross conveying device of the present invention. FIG. 2 is a view in the direction of the arrow II in FIG. 1. This cross conveying device 10 is formed so as to mount a sheet, which has been conveyed from a preceding devise toward a first direction (direction as indicated by the arrow A), onto a conveyance surface 20 and convey the sheet toward a second direction (direction as indicated by the arrow B) perpendicular to the first direction while guiding the sheet by an alignment guide 3. Incidentally, the sheet to be conveyed in this embodiment has a configuration folded into two.

Namely, the cross conveying device 10 comprises a discharging roller 1 which sandwiches the sheet from above and below and discharges it toward the first direction, a lot of conveying rollers 2 which mount and convey the sheet having been discharged, and the alignment guide 3 which guides a front edge (i.e. a folded line) of the first direction of the sheet to be conveyed.

Figure 3:
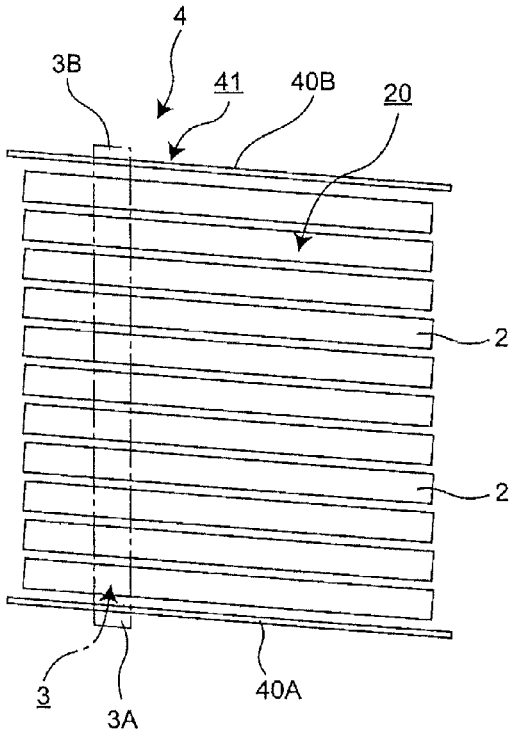
FIG. 3 is a plan schematic view showing an alignment guide moving mechanism.

Also, as shown in FIG. 3, the cross conveying device 10 further comprises an alignment guide moving mechanism 4. The alignment guide moving mechanism 4 is formed so as to be able to reciprocate the alignment guide 3 along the first direction at the predetermined time.

The conveying roller 2 is provided so that a conveyance direction (direction as indicated by the arrow C) is inclined toward the alignment guide 3 with respect to the second direction. The conveyance surface 20 is comprised of a lot of conveying rollers 2.

As shown in FIG. 2, the alignment guide 3 includes a guide surface 31 which abuts on a front edge of the first direction of the sheet and guides the sheet, and a first rotation assembly 32 and a second rotation assembly 33 which are arranged in zigzag alignment along the second direction. The second rotation assembly 33 is located away from the guide surface 31 than the first rotation assembly 32.

Figure 4:
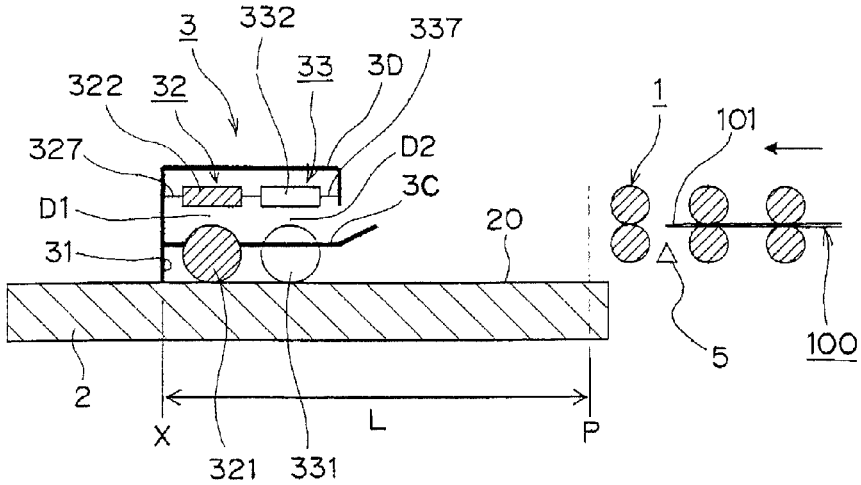
FIG. 4 is a cross-sectional schematic view taken along the line IV-IV in FIG. 2 showing a state of starting operation of the cross conveying device of the present invention.

As shown in FIG. 4 which is a cross-sectional view taken along the line IV-IV in FIG. 2, the first rotation assembly 32 is comprised of a spherical body 321 and a rotation roller (rotation member) 322 which is located above the spherical body 321. The spherical body 321 is provided so as to be able to mount onto the sheet 100 and rotate there in any direction. The spherical body 321 serves as a load member which applies a load to the sheet 100 directly from above. The rotation roller 322 is provided so as to rotate to allow the spherical body 321 abutting on it from below to rotate at least along the second direction. The second rotation assembly 33 also is comprised of the spherical body 331 and the rotation roller (rotation member) 332 which is located above the spherical body 331. The spherical body 331 is provided so as to be able to mount onto the sheet 100 and rotate there in any direction. The spherical body 331 serves as a load member which applies a load to the sheet 100 directly from above. The rotation roller 332 is provided so as to rotate to allow the spherical body 331 abutting on it from below to rotate at least along the second direction.

Specifically, the alignment guide 3 includes the guide surface 31, a flange part 3C which supports the spherical bodies 321, 331 rotatably, and a flange part 3D which supports the spherical bodies 322, 332 rotatably.

Figure 8:
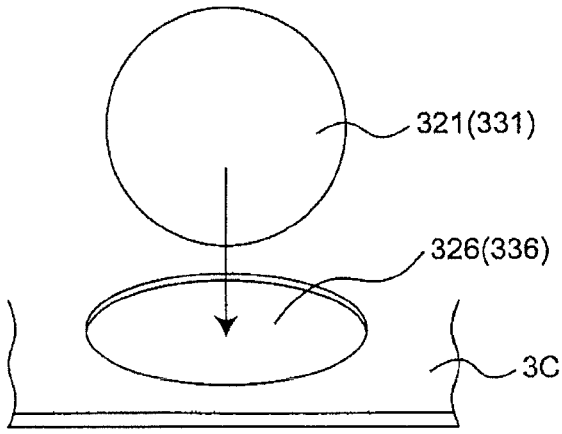
FIG. 8 is a perspective view showing the relationship between a spherical body and a flange part.

As shown in FIG. 8, the spherical body 321 is held rotatably in a through-hole 326 of the flange part 3C. The through-hole 326 has a diameter larger than that of the spherical body 321. The spherical body 331 is also held rotatably in a through-hole 336 of the flange part 3C. The through-hole 336 has a diameter larger than that of the spherical body 331.

The rotation roller 322 is supported rotatably by the flange part 3D by means of the horizontal rotation axis 327 which extends toward the direction perpendicular to the second direction. A gap D1 is provided between the spherical body 321 and the rotation roller 322. The gap D1 is set to a size that the spherical body 321 can move upward in order to mount onto the sheet 100. In the same way, the rotation roller 332 is also supported rotatably by the flange part 3D by means of the horizontal rotation axis 337. A gap D2 is provided between the spherical body 331 and the rotation roller 332. The gap D2 is set to a size that the spherical body 331 can move upward in order to mount onto the sheet 100. Incidentally, D1 and D2 may be same or different.

The alignment guide moving mechanism 4 includes a reciprocating mechanism 41 which can reciprocate the alignment guide 3 along the first direction, and a movement control part (not shown) which controls the reciprocating mechanism 41.

Figure 5:
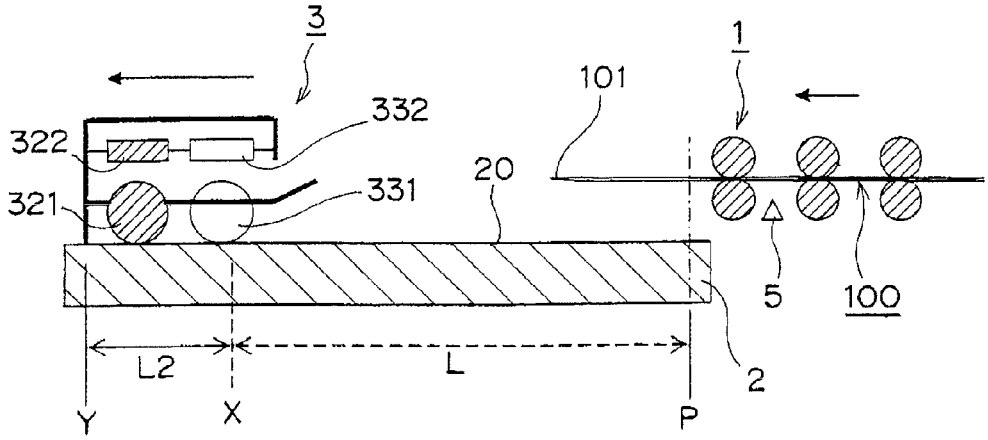
FIG. 5 is a cross-sectional schematic view showing the operation state subsequent to FIG. 4.
Figure 9:
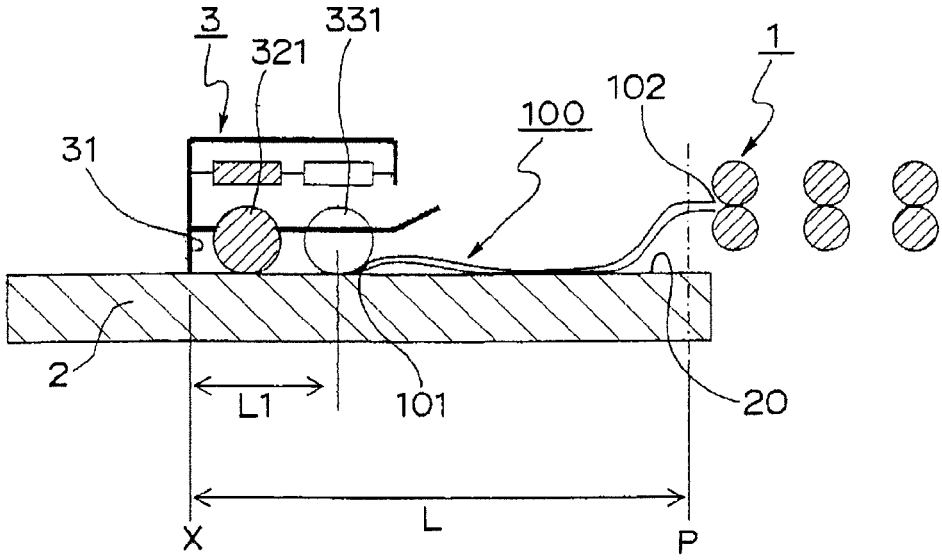
FIG. 9 is a view corresponding to FIG. 4 showing a trouble in the cross conveying device.

Specifically, as shown in FIG. 3, the reciprocating mechanism 41 includes a pair of screw axes 40A, 40B which pass through the both ends 3A, 3B of the alignment guide 3, and a drive source (not shown) which drives the screw axes 40A, 40B rotatably. The drive source is, for example, a motor. The reciprocating mechanism 41 is formed so as to be able to move the alignment guide 3 remaining parallel to the second direction between a guide position and a retraction position by driving the screw axes 40A, 40B rotatably by the drive source. The guide position is a position where the guide surface 31 abuts on the front edge 101 of the sheet 100 having finished mounting onto the conveyance surface 20. That is, when the alignment guide 3 is located at the guide position, the guide surface 31 is located at a position X which is a distance L away from the reference position P, as shown in FIG. 4. The distance L is the length of the first direction of the sheet having a folded configuration. The retraction position is a position where the spherical body 331 does not make contact with the front edge 101 of the sheet 100 having finished mounting onto the conveyance surface 20. That is, when the alignment guide 3 is located at the retraction position, the guide surface 31 is located at the position Y which is "distance L+distance L2" away from the reference position P, as shown in FIG. 5. The distance L2 is a little larger than the distance L1 shown in FIG. 9. Incidentally, the distance L1 is a size from the lowest point of the spherical body 331 to the guide surface 31.

The movement control part includes a sensor 5 which is provided adjacent to the upstream side of the discharging roller 1. The sensor 5 is adapted to detect a front edge 101 and a rear edge 102 of the sheet 100 being conveyed toward the first direction. When the movement control part detects a time when the sheet 100 begin to mount onto the conveyance surface 20, the movement control part controls the reciprocating mechanism 41 so as to move the alignment guide 3 from the guide position to the retraction position, and when the movement control part, detects a time when the sheet 100 has finished mounting onto the conveyance surface 20, the movement control part controls the reciprocating mechanism 41 so as to move the alignment guide 3 from the retraction position to the guide position. Incidentally, "a time when the sheet 100 begin to mount onto the conveyance surface 20" is "a time when the sensor 5 detects the front edge 101 of the sheet 100", and also "a time when the sheet 100 has finished mounting onto the conveyance surface 20" is "a time when the predetermined time T has passed since the sensor 5 detects the rear edge 102 of the sheet 100". This predetermined time T means the time after the sensor 5 detects the rear edge 102 and before the sheet 100 completely falls onto the conveyance surface 20.

Next, it is described an operation of the cross conveying device having the above-described construction.

Firstly, in a state that the conveying roller 2 is stopped, the sheet 100 with the front edge 101 located in front is conveyed from the preceding device toward the first direction. And when the sensor 5 detects the front edge 101 of the sheet 100 as shown in FIG. 4, the movement control part controls the reciprocating mechanism 41 and moves the alignment guide 3 from the guide position to the retraction position as shown in FIG. 5.

Figure 6:
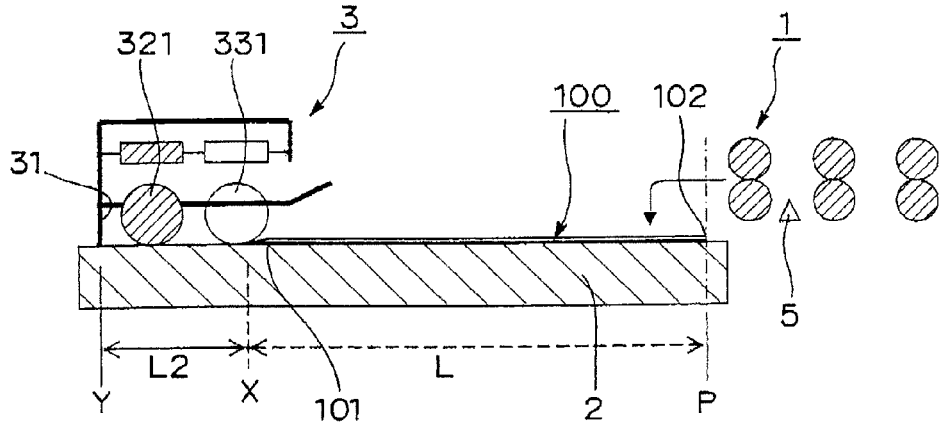
FIG. 6 is a cross-sectional schematic view showing the operation state subsequent to FIG. 5.

Next, when the sensor 5 detects the rear edge 102 of the sheet 100, the movement control part stops the reciprocating mechanism 41 until the predetermined time T is passed. According to this, as shown in FIG. 6, the sheet 100 completely falls onto the conveyance surface 20, the rear edge 102 is located in the reference position P, and the front edge 101 is located at the position where the front edge 101 does not make contact with the spherical body 331.

Figure 7:
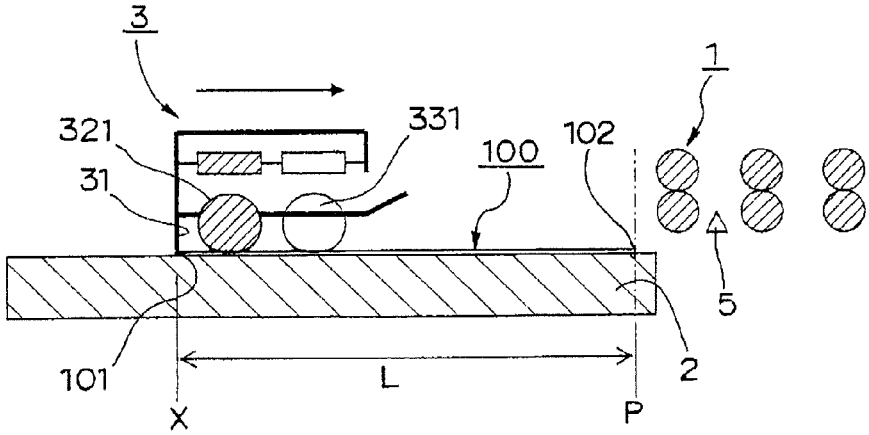
FIG. 7 is a cross-sectional schematic view showing the operation state subsequent to FIG. 6.

Next, after the predetermined time T is passed, the movement control part controls the reciprocating mechanism and moves the alignment guide 3 from the retraction position to the guide position, as shown in FIG. 7. According to this, the spherical bodies 331, 321 go over the front edge 101 of the sheet 100 and mount onto the sheet 100, and the guide surface 31 abuts on the front edge 101.

In this time, due to the gap D2 between the spherical body 331 and the rotation roller 332, the spherical body 331 can move upward, and also due to the gap D1 between the spherical body 321 and the rotation roller 322, the spherical body 321 can move upward. Therefore, the alignment guide 3 can move to the guide position without difficulty. Furthermore, the spherical bodies 331, 321 move upward, however, they can not get through upward because of the rotation rollers 332, 322.

And then, the conveying roller 2 begins operating. According to this, the sheet 100 is conveyed toward the direction as indicated by the arrow C, namely, the sheet 100 is conveyed toward the second direction while being conveyed to the alignment guide 3 side and being guided by the guide surface 31. At this time, because a load is applied to the sheet 100 from above by the spherical bodies 331, 321, the sheet 100 receives a conveying force strongly by the conveying roller 2, therefore, the sheet 100 is conveyed reliably without slipping.

Incidentally, when the sheet 100 is conveyed by the conveying rollers 2 and completely discharged from the conveyance surface 20, the conveying rollers 2 stop and the cross conveying device 10 becomes into the state as shown in FIG. 4, i.e. the state that the device 10 is ready to receive the following sheet 100, and after that, the cross conveying device 10 operates in the same way described above until the device 10 becomes into the state in FIG. 7 and conveys the sheet 100. In this way, the conveying rollers 2 are controlled so that, when the sheet 100 is received on the conveyance surface 20, the conveying rollers 2 are stopped until the front edge 101 of the sheet 100 abuts on the guide surface 31 of the alignment guide 3, and after abutting, the conveying rollers 2 are operated. Therefore, according to the cross conveying device 10, it is possible to prevent the sheet 100 from being conveyed obliquely.

As described above, in the cross conveying device 10 having the above-mentioned construction, when the sheet 100 having been conveyed from the preceding devise is mounted onto the conveyance surface 20, the alignment guide 3 is located at the retraction position, therefore, the sheet 100 may not jam short of the spherical bodies 331, 321 of the alignment guide 3. And after the sheet 100 is mounted onto the conveyance surface 20, the alignment guide 3 is located at the guide position, therefore, the front edge 101 of the sheet 100 abuts on the guide surface 31 reliably.

Therefore, according to the cross conveying device 10 having the above-mentioned construction, even if the sheet 100 is easy to break, the device 10 can mount the sheet 100 onto the conveyance surface 20 and convey it while guiding it by the alignment guide 3 reliably.

Modified Configuration (1) The sheet 100 to be conveyed by the cross conveying device 10 is not only limited to the above-mentioned configuration folded into two, but also a configuration folded into three, for example, C-folding, Z-folding, gate-folding etc. and a configuration folded into four or more. Namely, in the above-mentioned embodiment of the cross conveying device 10, even if the sheet 100 has a configuration folded into plural, it is possible to convey the sheet 100 so that the front edge 101 of the first direction of the sheet including the folded line moves along the guide surface 31 of the alignment guide 3 reliably.

(2) The sheet 100 to be conveyed by the cross conveying device 10 may have an un-folded configuration.

Industrial Applicability

Even if the sheet 100 is easy to break, the cross conveying device 10 of the present invention can mount the sheet 100 onto the conveyance surface 20 and convey it while guiding it by the alignment guide 3 reliably, therefore, the cross conveying device 10 is industrially very useful.

What is claimed is:

1. A cross conveying device for mounting a planar-view-rectangle sheet, which has been conveyed from a preceding devise toward a first direction, onto a conveyance surface and conveying the sheet toward a second direction perpendicular to the first direction while moving it along an alignment guide, wherein the alignment guide comprises a guide surface which abuts on a front edge of the first direction of the sheet and guides the sheet, and a rotatable spherical body which mounts onto the sheet abutting on the guide surface and applies a load to the sheet, an alignment guide moving mechanism is provided, the alignment guide moving mechanism comprises a reciprocating mechanism which can reciprocate the alignment guide along the first direction, and a movement control part which controls the reciprocating mechanism, the reciprocating mechanism is formed so as to be able to move the alignment guide between a guide position where the guide surface abuts on the front edge of the first direction of the sheet having finished mounting onto the conveyance surface and a retraction position where the spherical body does not make contact with the front edge of the first direction of the sheet having finished mounting onto the conveyance surface, the movement control part controls the reciprocating mechanism so as to move the alignment guide from the guide position to the retraction position when the movement control part detects a time when the sheet begins to mount onto the conveyance surface, and the movement control part controls the reciprocating mechanism so as to move the alignment guide from the retraction position to the guide position when the movement control part detects a time when the sheet has finished mounting onto the conveyance surface.

2. The cross conveying device according to claim 1, wherein the alignment guide includes a first rotation assembly and a second rotation assembly which are arranged in zigzag alignment along the second direction, the second rotation assembly is located away from the guide surface than the first rotation assembly, each rotation assembly has a spherical body and a rotation member which is located above the spherical body, the spherical body is provided so as to be able to mount onto the sheet to apply a load to the sheet and also rotate there in any direction, the rotation member is provided so as to rotate to allow the spherical body abutting on it from below to rotate at least along the second direction, the retraction position is a position where the spherical body of the second rotation assembly does not make contact with the front edge of the first direction of the sheet having finished mounting onto the conveyance surface.

* * * * *